United States Patent [19]

Davis et al.

[11] 4,255,097

[45] Mar. 10, 1981

[54] FUEL INJECTION PUMP

[75] Inventors: Charles W. Davis, Simsbury; Charles J. Donahue, Enfield, both of Conn.

[73] Assignee: Stanadyne, Inc., Windsor, Conn.

[21] Appl. No.: 62,356

[22] Filed: Jul. 31, 1979

[51] Int. Cl.[3] ..... F04B 29/00

[52] U.S. Cl. ..... 417/462

[58] Field of Search ..... 417/462, 460

[56] References Cited

U.S. PATENT DOCUMENTS

| | | | |
|---|---|---|---|
| 3,267,761 | 8/1966 | Pigeroulet et al. | 417/486 |
| 4,144,000 | 3/1979 | Hollett et al. | 417/462 |
| 4,188,175 | 2/1980 | Bonin | 417/462 |

*Primary Examiner*—William L. Freeh

*Attorney, Agent, or Firm*—Prutzman, Kalb, Chilton & Alix

[57] ABSTRACT

This invention relates to fuel injection pumps of the type employed for supplying measured charges of fuel to the nozzles of an associated internal combustion engine. More particularly, the invention relates to such fuel pumps of the rotary distributor type having pumping plungers which are slidably mounted in radial bores of a rotary distributor and are surrounded by a generally circular cam ring having pairs of inwardly directed cam lobes which actuate pairs of pumping plungers inwardly simultaneously for pressurizing the charge of fuel between the plungers to a high pressure.

The subject invention overcomes the above problems by angularly spacing a pair of pumping plungers and the cooperating cam lobes as required for the specific engine application and avoids the undesired side loading by creating a hydraulic counterbalancing force which automatically changes as the side loading created by the reaction forces between the cam lobes and the pumping plungers changes with speed and rate of delivery of fuel. This is accomplished without introducing any added moving parts to the pump.

8 Claims, 7 Drawing Figures

FUEL INJECTION PUMP

This invention relates to fuel injection pumps of the type employed for supplying measured charges of fuel to the nozzles of an associated internal combustion engine. More particularly, the invention relates to such fuel pumps of the rotary distributor type having pumping plungers which are slidably mounted in radial bores of a rotary distributor and are surrounded by a generally circular cam ring having pairs of inwardly directed cam lobes which actuate pairs of pumping plungers inwardly simultaneously for pressurizing the charge of fuel between the plungers to a high pressure.

Generally, such pumping plungers are mounted on a common diametral axis and the cooperating cam lobes are also provided in pairs disposed 180° apart to actuate the plungers inwardly along the common axis so that side loading is not applied to the rotary distributor. However, for certain types of engines such as an even firing five cylinder engine or an uneven firing V-6 engine, the cooperating cam lobes and the pairs of pumping plungers cannot be readily placed on a common diametral axis.

In the past, efforts to provide a rotary distributor pump suitable for such engine applications without introducing undesirable side loading have been complicated by incorporating an additional pumping plunger. Such pumps are shown in U.S. Pat. No. 3,267,861, dated Aug. 23, 1966 and U.S. Pat. No. 3,506,381 which issued Apr. 14, 1970.

A recent effort to overcome the complication of incorporating an additional pumping plunger and maintain the simplicity of a two plunger pump with the plungers having a common axis resulted in the design shown by U.S. Pat. No. 4,144,000 which issued Mar. 13, 1979. In this patent, a transverse beam engageable with a pair of cam lobes is used for actuating one of the pumping plungers.

The claimed invention overcomes the above problems by angularly spacing a pair of pumping plungers and the cooperating cam lobes as required for the specific engine application and avoids the undesired side loading by creating a hydraulic counterbalancing force which automatically changes as the side loading created by the reaction forces between the cam lobes and the pumpin plungers changes with speed and rate of delivery of fuel. This is accomplished without introducing any added moving parts to the pump.

Figure 1:
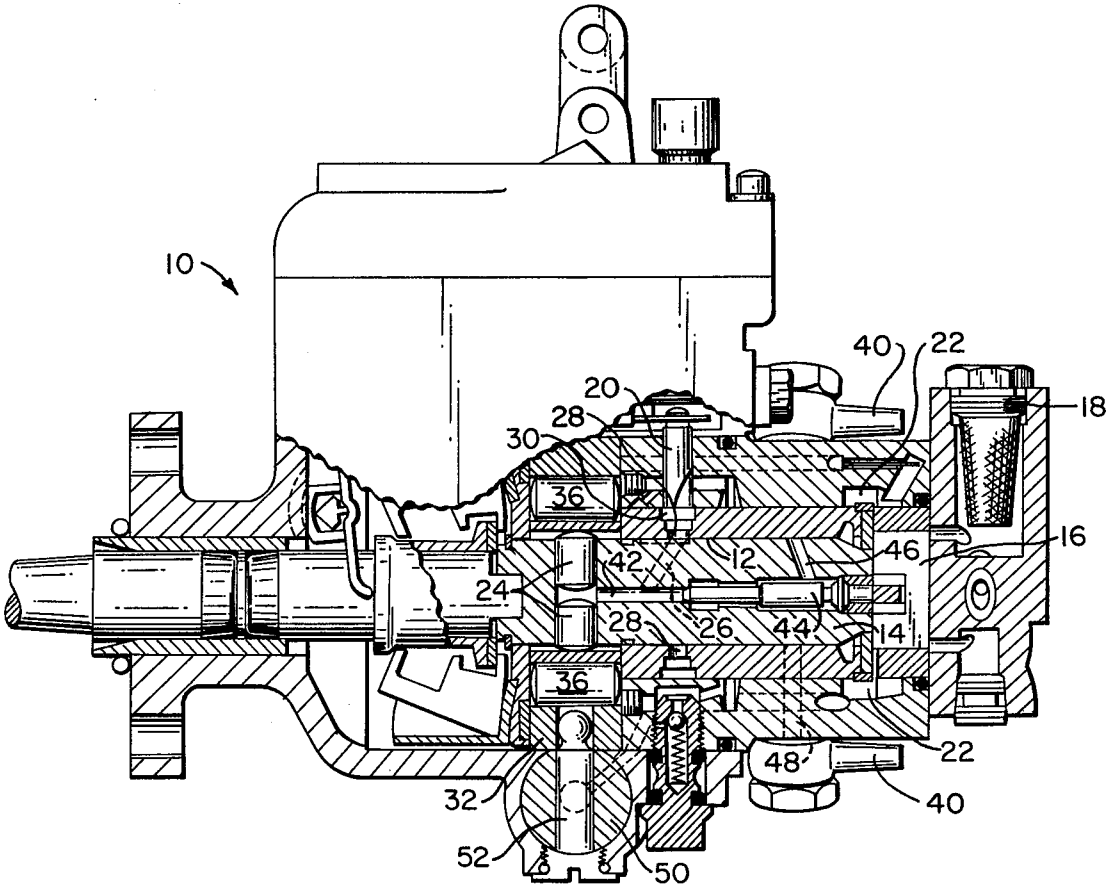
FIG. 1 is a front elevation view, partly in section and partly broken away, of a fuel injection pump embodying the present invention and suited for use with an uneven firing V-6 engine.

Referring now to the drawings in detail, the fuel pump 10 exemplifying the present invention is shown to be of a type for supplying measured charges of fuel to the several fuel injection nozzles of an associated internal combustion engine. The pump has an axial bore 12 in which the rotary distributor 14 is journaled. At the right end of the pump as viewed in FIG. 1, a vane-type transfer or low pressure supply pump 16 is mounted by the rotor to be driven thereby and receives fuel from a reservoir (not shown) through a pump inlet 18 and delivers fuel under pressure to a metering valve 20. A pressure regulating valve (not shown) is mounted in a bypass passage between the outlet 22 and the inlet 18 of the transfer pump 16 to regulate the output pressure of the transfer pump and provide a pressure correlated with engine speed.

A high pressure charge pump, which comprises a pair of plungers 24 slidably mounted in radial bores of the rotor, receives metered fuel from the metering valve through a diagonal passage 26 in the rotor adapted for sequential registration with ports 28 communicating with passage 30 downstream of the metering valve 20 as the rotor is rotated. Surrounding the rotor in the plane of revolution of the plungers 24 is a generally circular cam ring 32 having a plurality of inwardly extending cam lobes 34 which are adapted to actuate the plungers 24 inwardly simultaneously to pressurize the charge of fuel therebetween. It will be understood that the rollers 36 and roller shoes 38 are disposed between the plungers 24 and the cam ring 32 so that the rollers act as cam followers for translating the cam contour into reciprocable movement of the plungers.

As the rotor rotates, the charge pump supplies sequential measured charges of fuel under high pressure. One of the ports 28 registers with inlet passage 26 when the rollers 36 are angularly disposed between adjacent cam lobes so that the plungers 24 may move outwardly to charge the charge pump with fuel regulated by metering valve 20. When the rollers engage the cam lobes, the plungers are forced inwardly to pressurize fuel which is delivered under high pressure through axial passage 42 past a delivery valve 44 and through a generally radial distributor passage 46 which sequentially registers with a plurality of angularly spaced passages 48 in the pump to deliver charges of fuel to the fuel injection nozzles of the associated engine through pump outlets 40.

The relative timing of injection of fuel is controlled by cam ring 32 which may be angularly adjusted by a conventional timing piston 50 connected to the cam ring 32 by a connector 52 to shift the angular position of the cam ring as desired.

As stated above, the embodiment of FIGS. 1–4 is suited for use with an uneven firing V-6 engine.

Figures 2, 3, 4, 5, 6, 7:
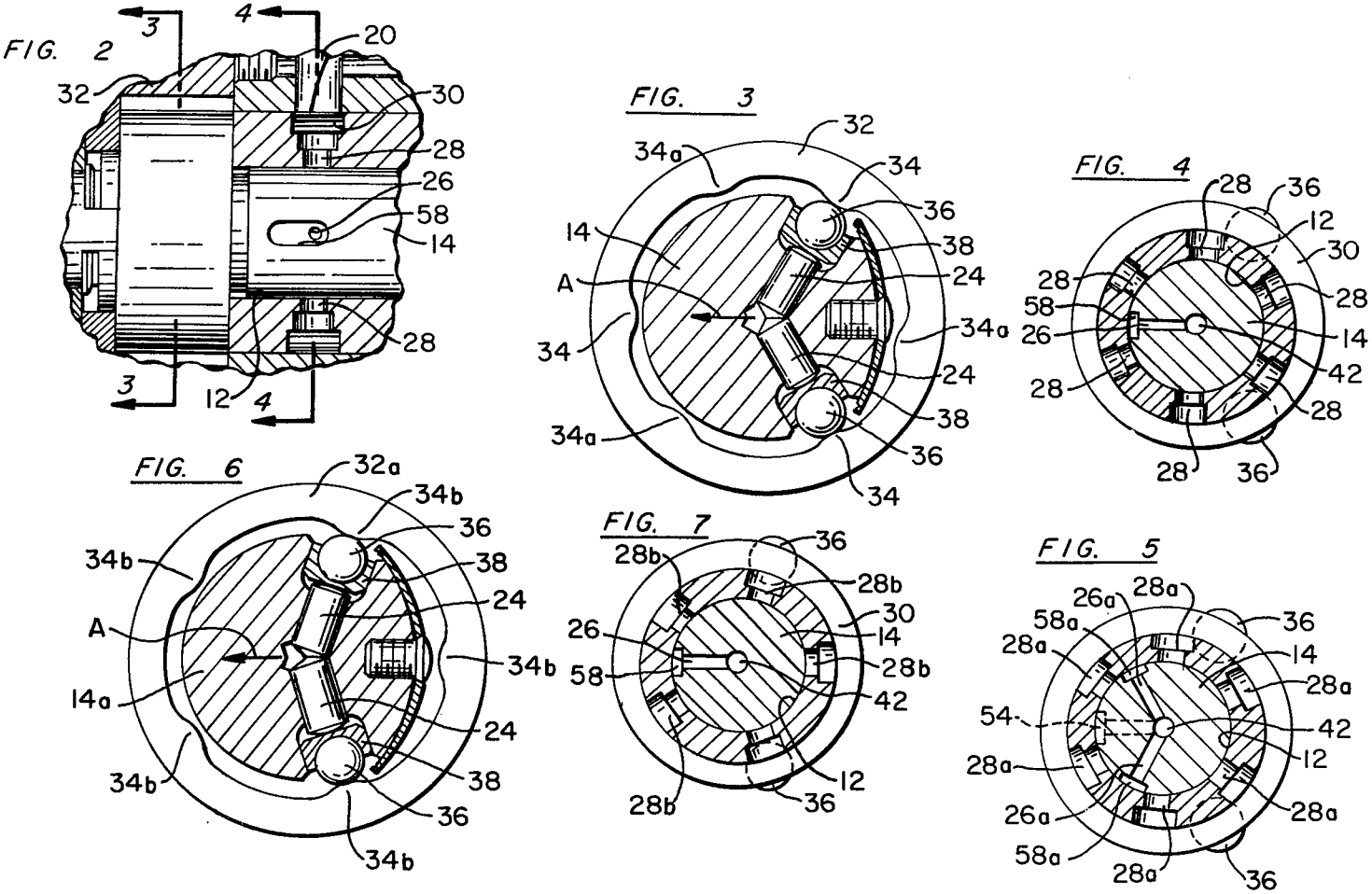
FIG. 2 is an enlarged fragmentary front elevetion view of the rotary distributor of the pump with the adjacent portion of the pump shown in section.
FIG. 3 is a sectional view taken along line 3—3 of FIG. 2.
FIG. 4 is a sectional view taken along the line 4—4 of FIG. 2.
FIG. 5 is a sectional view similar to FIG. 4 of a variant form of the invention.
FIG. 6 is a sectional view similar to FIG. 3 of a variant form of the invention suited for use with an even firing five cylinder engine.
FIG. 7 is a sectional view similar to FIG. 4 of the variant form of the invention shown in FIG. 5.

The pair of pumping plungers 24 and their associated rollers 36 and shoes 38 are angularly spaced on axes 120° apart as shown in FIG. 3. The cam ring has a first set of three cam lobes 34 which are also angularly spaced 120° apart for the simultaneous actuation of the two pumping plungers to deliver charges of fuel to the three cylinders of one of the banks of the V-6 engine. The cam ring 32 is also provided with a second set of three cam lobes **34*a* which are angularly displaced 120° from each other to deliver charges of fuel to the three cylinders of the other bank of the engine. As shown, the two sets of three cam lobes 34 and 34*a* are equiangularly spaced with respect to each other but the angular spacing between cam lobes of the two sets is uneven as required for an uneven firing V-6 engine. The inlet passages 28 and the discharge passage 48** are respectively angularly located to have the same spacing as the cam lobes for alternate charging and pumping strokes of the pump.

It is apparent from FIG. 3 that the reaction force between the two rollers 36 and the cooperating cam lobes will create a side loading on the distributor rotor 14 during each pumping stroke and that the side loading will be along a radial vector indicated by the arrow A in FIG. 3.

According to this invention, means are provided for hydraulically counterbalancing such side loading on the rotary distributor. As shown in FIG. 4, the inlet passage 26 which terminates in a port in the form of an enlarged chamber or pad 58 communicates with axial passage 42 of the rotary distributor 14. During the pumping stroke, the pressurized fuel in inlet passage 26 creates a hydraulic force between the rotary distributor and the bore 12 in which it is journaled and, according to the invention, the port of inlet passage 26 is angularly oriented so that this hydraulic force is aligned with radial vector A, but acts in the opposite direction.

Since the pressure in pad 58 varies with the output pressure of the charge pump, it is apparent that the hydraulic force counterbalancing the side loading varies in accordance with the amount of side loading created at different pumping pressures.

Alternatively, as shown in FIG. 5, a pair of inlet passages **26*a* angularly disposed 120° apart may be substituted for a single inlet passage to produce a resultant hydraulic force which is radially aligned with radial vector A but acts in the opposite direction. Such inlet passages 26*a* preferably terminate in axially elongated pressure pads 58*a* of equal size disposed angularly symmetrically with respect to radial vector A. In addition, balance hole 54, shown in dotted lines in FIG. 5, may be used in conjunction with the pair of inlet passages 26*a*. Such a balance hole should be radially aligned with radial vector A and axially spaced from inlet passages 26*a* so as not to register with inlet ports 28*a***.

As shown in FIG. 4, inlet passage 26 does not register with an inlet port 28 during pumping strokes when the rollers engage the cam lobes. Similarly, as shown in FIG. 5, inlet passages **26*a* do not register with inlet ports 28*a* during pumping strokes. In each embodiment, however, the inlet ports register with the inlet passages each time that the rollers 36** are disposed between adjacent pairs of cam lobes in order to charge the pump.

Thus, by suitable angular orientation of the inlet passages and propely sizing the cross-sectional areas of the pads in which they terminate, an automatically adjustable counterbalancing hydraulic force may be established without interfering with the normal operation of the charge pump. Moreover, it will be observed from FIGS. 3, 4, and 5, that the pressure pads of the inlet passages, and of the balance hole 54, if used, serve to provide to lubricate the rotary distributor where side loading would otherwise be greatest. This may permit satisfactory operation where something less than complete hydraulic counterbalance is effected.

The variant shown in FIGS. 6 and 7 illustrates the use of the invention with respect to a five-cylinder even firing engine. In this variant, a single inlet passage 26 is used. The cam lobes **34*b* and the inlet ports 28*b* are evenly spaced 72° apart and the inlet ports 28*b* are angularly located so as to register with inlet passage 26 when the rollers 36 are between adjacent cam lobes in order to charge the pump. The ports 28*b* are out of registry with the inlet passage 26 during the pumping stroke of the pumping plungers 24 as shown in FIG. 7. The pumping plungers 24, as shown in FIG. 6**, are preferably angularly displaced 144° from each other to produce the minimum side loading on the rotary distributor.

It will be understood that a pair of inlet passages angularly spaced from each other by 72°, either alone or in combination with a balance hole, may be used in lieu of a single inlet passage in this variant in a manner similar to that disclosed in FIG. 5.

From the foregoing, it will be apparent that this invention permits the use of a pair of pumping plungers not located on a common diametral axis without the use of any additional parts by creating a hydraulic counterbalancing force which automatically adjusts in accordance with the pressure levels generated in the charge pump at different pumping speeds and pumping rates.

As will be apparent to persons skilled in the art, various modifications, adaptations and variations of the foregoing specific disclosure can be made without departing from the teachings of the present invention.

We claim:

1. A liquid fuel injection pump having a longitudinal bore, a rotary distributor journaled in the bore, the distributor providing a pair of generally radial communicating non-coaxial bores, a pair of pumping plungers slidably mounted in said non-coaxial bores to form a pumping chamber therebetween, and a cam ring mounted about the axis of rotation of the distributor and having cam lobes to impart simultaneous inward movement to the pumping plungers as the distributor rotates characterized in that the distributor and the longitudinal bore define chamber means therebetween, passage means in the distributor providing continuous communication between the chamber means and the pumping chamber with the chamber means being angularly disposed to create a hydraulic force on said distributor substantially radially aligned with but in a direction opposite to the radial vector of side loading imposed on the distributor during the pumping stroke of the pumping plungers.

2. The liquid fuel injection pump of claim 1 further characterized in that the chamber means includes a balance hole terminating in a pressure pad which is radially aligned with the radial vector.

3. The liquid fuel injection pump of claim 1 further characterized in that the chamber means is of a size to create a hydraulic counterbalancing force which substantially balances the side loading.

4. The liquid fuel injection pump of claim 1 further characterized in that the cam ring has five cam lobes equianglarly spaced around its inner periphery and in that a pair of alternate lobes actuate the pumping plungers.

5. The liquid fuel injection pump of claim 1 further characterized in that the passage means includes a pair of inlet passages for supplying fuel to the pumping chamber with the inlet passages being disposed of opposite sides of the radial vector of the side loading on the distributor.

6. The liquid fuel injection pump of claim 5 further characterized in that the pair of inlet passages are angularly symmetrical with respect to the radial vector.

7. The liquid fuel injection pump of claim 1 further characterized in that the cam ring has two sets of equiangularly spaced lobes around its inner periphery and in that pairs of cam lobes of each set alternately actuate the pumping plungers.

8. The liquid fuel injection pump of claim 7 further characterized in that the angular spacing of adjacent lobes of the cam ring is unequal.

* * * * *